United States Patent [19]

Yoshida et al.

[11] Patent Number: 4,485,532

[45] Date of Patent: Dec. 4, 1984

[54] SEPARABLE SLIDE FASTENER

[75] Inventors: Hiroshi Yoshida; Shunji Akashi, both of Kurobe; Yoshio Matsuda, Nyuzen, all of Japan

[73] Assignee: Yoshida Kogyo K. K., Tokyo, Japan

[21] Appl. No.: 300,670

[22] Filed: Sep. 9, 1981

[30] Foreign Application Priority Data

Sep. 10, 1980 [JP] Japan ..... 55-125840

[51] Int. Cl.[3] ..... A44B 19/24

[52] U.S. Cl. ..... 24/381; 24/395; 24/413; 24/434

[58] Field of Search ..... 24/205.16 R, 205.11 R, 24/205 R, 205.11 F, 381, 395, 413, 434; 66/192, 193, 195

[56] References Cited

U.S. PATENT DOCUMENTS

| | | | |
|---|---|---|---|
| 2,098,338 | 11/1937 | Gilmore | 24/205.11 F |
| 2,652,705 | 9/1953 | Weinberg | 24/205.16 R |
| 3,030,684 | 4/1962 | Johns et al. | 24/205.11 F |
| 3,377,668 | 4/1968 | Carlile et al. | 24/205.11 F |
| 3,435,489 | 4/1969 | Morin | 24/205.11 F |
| 3,616,939 | 11/1971 | Potin | 24/205.11 F |
| 3,618,178 | 11/1971 | Hansen | 24/205.11 F |
| 3,752,718 | 8/1973 | Potin | 24/205.11 F |
| 4,001,922 | 1/1977 | Ward, Jr. | 24/205.11 F |
| 4,047,402 | 9/1977 | Matsuda et al. | 66/192 |
| 4,056,868 | 11/1977 | Ebata | 66/195 |
| 4,075,874 | 2/1978 | Heimberger | 66/192 |
| 4,265,004 | 5/1981 | Akashi | 24/205.11 R |

FOREIGN PATENT DOCUMENTS

| | | | |
|---|---|---|---|
| 1059377 | 6/1959 | Fed. Rep. of Germany | 24/205.11 F |
| 2046137 | 3/1972 | Fed. Rep. of Germany | 66/195 |
| 51-135709 | 11/1976 | Japan . | |
| 52-24161 | 6/1977 | Japan . | |
| 7102225 | 8/1971 | Netherlands | 24/205.11 F |
| 508372 | 6/1971 | Switzerland | 24/205.11 F |

*Primary Examiner*—Gene Mancene
*Assistant Examiner*—James Hakomaki
*Attorney, Agent, or Firm*—Hill, Van Santen, Steadman & Simpson

[57] ABSTRACT

A separable slide fastener comprises a pair of warp-knit stringer tapes each having a pair of webs with a wale-free region therebetween, which are interconnected by a connector thread extending across the wale-free region at longitudinal intervals, the wale-free region being receptive of a chain of thread loops for attaching the stringer tape to a fabric. A pair of rows of coupling elements is mounted on opposite longitudinal edges of the stringer tapes, respectively and taken into and out of interdigitating engagement by a slider movable along the rows of coupling elements. The stringer tapes have at one end thereof a separable bottom end stop. A reinforcement member is mounted on each of the stringer tapes at the one end thereof and connected to the separable bottom end stop. The reinforcement member extends between the tape webs across the wale-free region and includes means adjacent to the wale-free region for anchoring an end of the chain of thread loops on the reinforcement member against displacement thereof. The anchoring means comprises a projection extending from a body of the reinforcement member in a direction away from the stringer tape and located substantially in alignment with one of the webs of the stringer tape. The projection serves to prevent the end of the loop chain extending around the reinforcement body from being displaced off the body.

7 Claims, 9 Drawing Figures

SEPARABLE SLIDE FASTENER

BACKGROUND OF THE INVENTION

1. Field of the Invention

The present invention relates to a separable slide fastener for use on knit garments such as cardigan sweaters.

2. Prior Art

There have been proposed separable slide fasteners which have in their stringer tapes longitudinal coarse regions or openings loosely receptive of a chain of thread loops for attaching the stringer tape to a knit garment. Such separable slide fasteners are described in copending U.S. patent application Ser. Nos. 223,201 and 258,647 filed Jan. 7, 1981 and Apr. 29, 1981, respectively, which have been assigned to the present assignee. The proposed separable slide fasteners are connected to knit garments on a knitting machine or linking machine with their needles insertable into the openings in the stringer tape. The separable slide fastener as attached to the knit garment is prevented from becoming puckered or wavy since the openings in the tape that loosely accommodate the thread loops take up forces applied to the knit garment. The knit garment such as a cardigan sweater, while worn with the slide fastener closed, is subjected to a lateral pull particularly at its hem or lower end around the wearer's waist, imposing more tension on a lower end of the slide fastener than on other parts of the latter. Therefore, an end of the chain of thread loops which extends around the lower end of the slide fastener is likely to be disposed laterally off the tape end under continued or sudden lateral stresses.

SUMMARY OF THE INVENTION

A separable slide fastener has a reinforcement member mounted on a lower end of each stringer tape and including a thin film bonded to the tape and thick body extending across a wale-free region of the tape and disposed around the end of the tape. The body has a projection located substantially in alignment with a web of the tape and extending away from the tape. When the slide fastener is attached to a knit fabric by a chain of thread loops, the projection prevents a lowermost thread loop disposed around the reinforcement body from being displaced off the body under lateral forces tending to pull the stringer tapes apart. The reinforcement body has a pair of protuberances projecting in a direction perpendicular to the stringer tape. The protuberances serve to anchor the lowermost thread loop stably on the reinforcement body and also to prevent wear on such thread loop. The body may have an additional projection parallel to and spaced from the first-mentioned projection, and these projections may be interconnected by a connector. As an alternative, the reinforcement member may comprise a pair of parallel spaced thick bodies, one of which is mounted on the tape with the other spaced from the tape, there being a projection extending from the other body for preventing a thread loop from being displaced off the bodies.

It is an object of the present invention to provide a separable slide fastener attachable to a knit garment and having means for anchoring a thread loop stably on a lower end of the slide fastener against displacement under forces applied to the knit garment to which the slide fastener is attached.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 2:
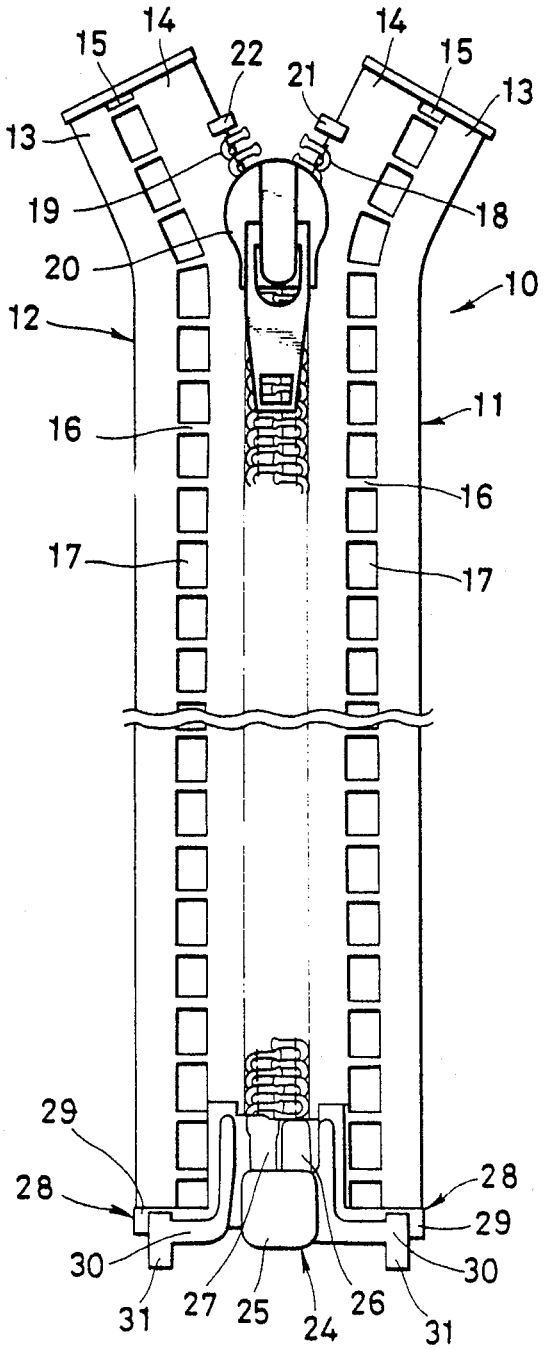
FIG. 2 is an enlarged plan view of a separable slide fastener according to the present invention.

As shown in FIG. 2, a separable slide fastener 10 for use on a garment such as a cardigan sweater having completely separable opposite edges along which the fastener is attachable, comprises a pair of warp-knit stringer tapes 11,12 each including a pair of first and second longitudinal warp-knit webs 13,14 with a wale-free coarse region 15 therebetween which is preferably devoid of one to four wales. The webs 13,14 are interconnected by a connector thread 16 extending transversely across the wale-free region 15 at longitudinal intervals, providing a plurality of rectangular openings 17 arranged longitudinally in and along the wale-free region 15. A pair of rows of coupling elements 18,19 which are made preferably of filamentary plastic material is mounted respectively on the second webs 14,14 along longitudinal opposite edges thereoff. A slider 20 is slidably mounted on the rows of coupling elements 18,19 for taking the latter into and out of interdigitating engagement to open and close the slide fastener 10.

A pair of top end stops 21,22 is secured respectively to the opposed edges of the webs 14,14 and located at an upper end of the stringer tapes 11,12 to prevent the slider 20 from moving off the rows of coupling elements 19 past the top end stops 21,22. A separable bottom end stop 24 is mounted on the lower ends of the stringer tapes 11,12 and includes a box 25 and a box pin 26 extending therefrom, the box 25 and the box pin 26 being injection-molded on the lower end of the stringer tape 11, and a pin 27 injection-molded on the end of the stringer tape 12 and insertable into and removable from the box 25 in parallel relation to the box pin 26. The separable bottom end stop 24 is located at a lower end of the rows of coupling elements 18,19.

Figure 3:
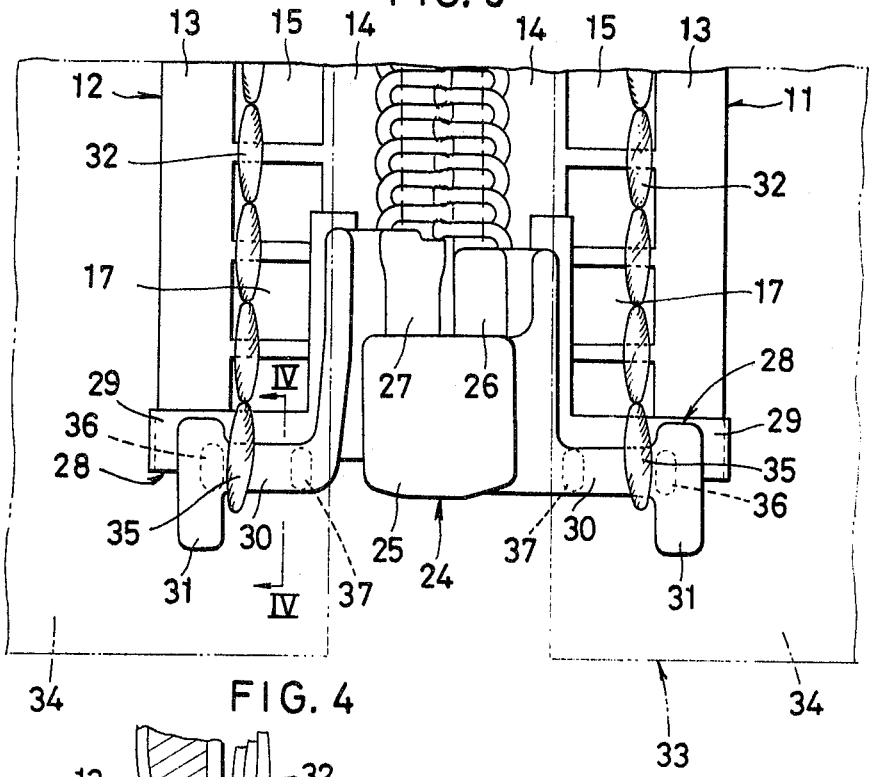
FIG. 3 is an enlarged fragmentary plan view of the separable slide fastener shown in FIG. 2.
Figure 4:
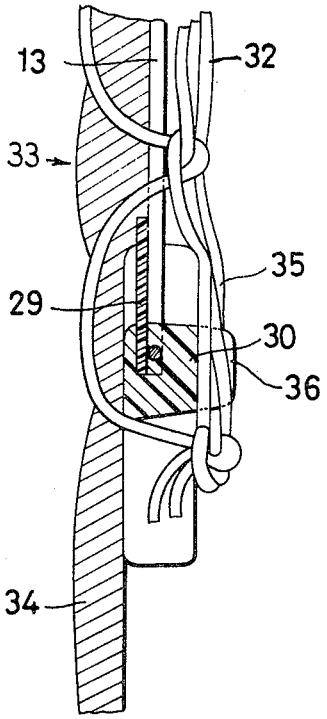
FIG. 4 is an enlarged cross-sectional view taken along line IV—IV of FIG. 3.

As best illustrated in FIG. 3, a pair of reinforcement members 28,28 of thermoplastic synthetic resin is mounted on the lower ends of the stringer tapes 11,12, respectively and connected to the separable bottom end stop 24. Each of the reinforcement members 28 includes an L-shaped thin film 29 bonded to the stringer tape and a thick body 30 injection molded on the tape and extending transversely between the first and second webs 13,14 across the wale-free region 15, the body 30 being disposed around the lower end of the stringer tape as best shown in FIG. 4. A projection 31 extends from the reinforcement body 30 substantially in alignment with the first web 13 and projects in a direction away from the stringer tape.

Figure 1:
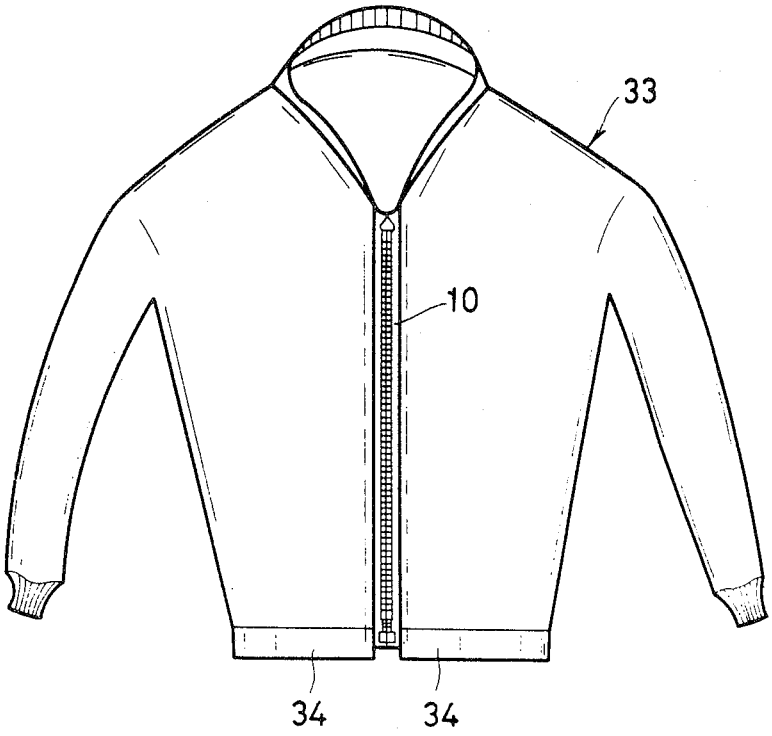
FIG. 1 is a front elevational view of a garment to which a separable slide fastener according to the present invention is attached.

The slide fastener 10 thus constructed is attached to a knit garment 33 (FIGS. 1, 3 and 4) such as a cardigan sweater by chains of thread loops 32 along the wale-free regions 15 on a knitting machine or a linking machine, the garment 33 having a hem or lower edge portion 34 which is the most stretchable when the garment 33 is worn with the slide fastener 10 closed and to which the lower ends of the stringer tapes 11,12 are attached. The chain of thread loops 32 includes a lowermost end loop 35 which extends around the reinforcement body 30 as shown in FIG. 4. The reinforcement body 30 has a pair of protuberances 36,37 disposed one on each side of the wale-free region 15 and projecting in a direction perpendicular to the stringer tape 11,12. The projection 31 serves to anchor the end loop 35 on the reinforcement body 30 against displacement thereof under forces applied via the hem 34 to the slide fastener 10. The protuberances 36,37 also prevent the end loop 35 from being displaced off the reinforcement body 30, and from becoming worn by repeated contact with the wearer's other clothes.

Figure 5:
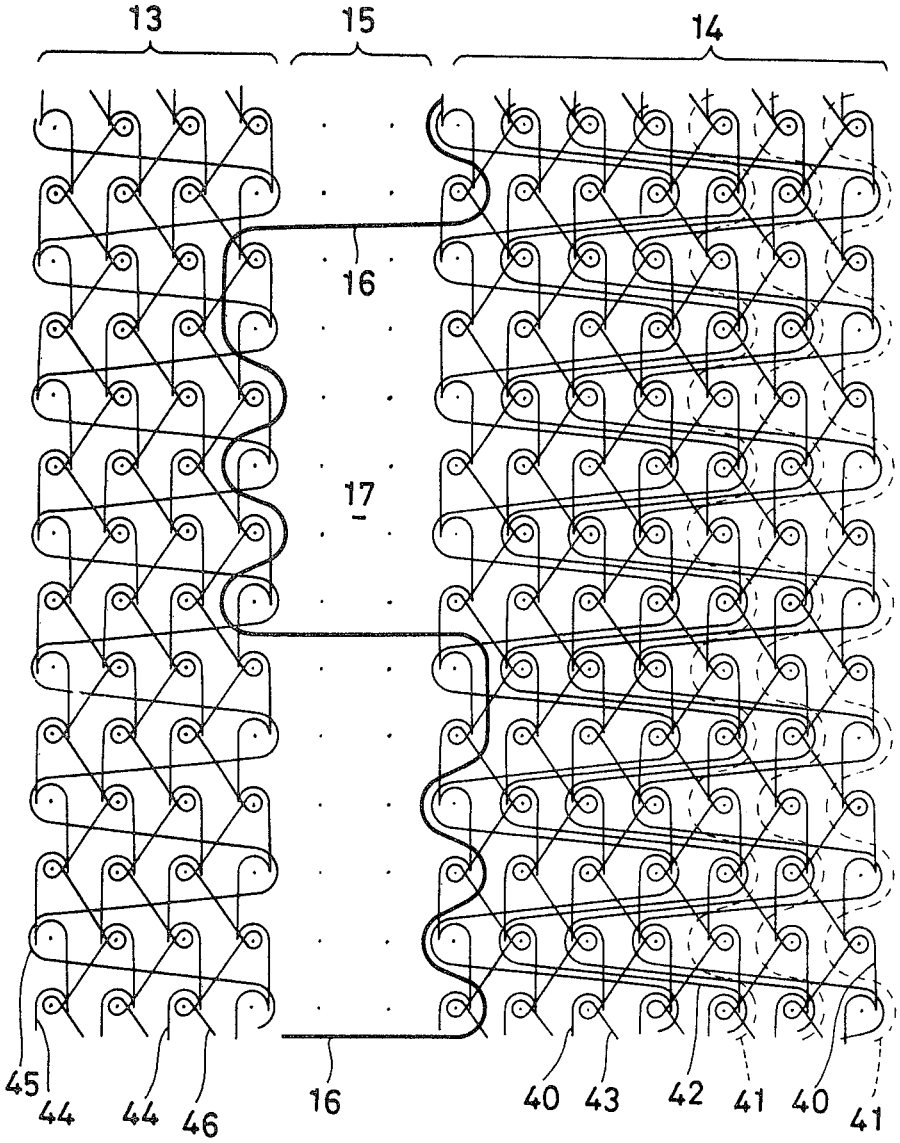
FIG. 5 is a point diagram showing lapping movements for a warp-knit stringer tape of the separable slide fastener shown in FIG. 2.

Each of the stringer tapes 11,12 is warp-knit in patterns as illustrated in FIG. 5. The second web 14 is composed of chain stitches 40 knit in the pattern of 1-0/0-1, warp threads 41 laid in the pattern of 0-0/1-1 along an edge of the web 14 for reinforcement thereof to support a row of coupling elements, weft threads 42 laid in the pattern of 0-0/4-4, and tricot stitches 43 knit in the pattern of 1-2/1-0. The first web 13 is composed of chain stitches 44 knit in the pattern of 1-0/0-1, a weft thread 45 laid in the pattern of 0-0/4-4, and tricot stitches 46 knit in the pattern of 1-2/1-0. The chain stitches 40,44 located along the edges of the webs 14,13 are made of threads thicker than those of other chain stitches to reinforce the wales along the edges of the webs 14,13. The connector thread 16 is laid in the pattern of 0-0/1-1/0-0/1-1/0-0/0-0/4-4/3-3/4-4/3-3/4-4/4-4 across the wale-free region 15. The connector thread 16 is made of a plurality of twisted yarns (for example, #20) which are thicker than other foundation threads.

Figure 6:
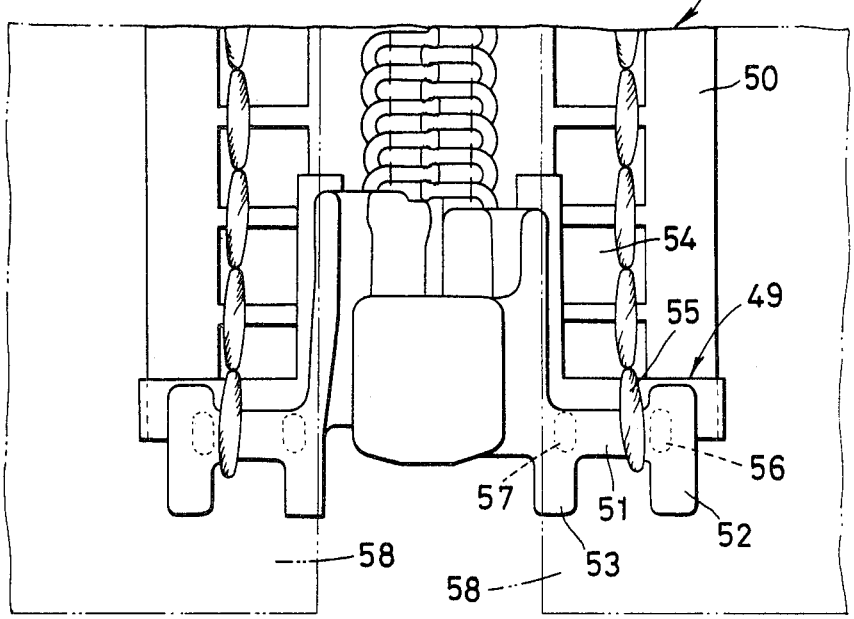
FIGS. 6, 7 and 8 are fragmentary plan views of modified separable slide fasteners according to the present invention.

FIG. 6 illustrates a modified separable slide fastener 48 including a reinforcement member 49 mounted on a lower end of each stringer tape 50 and comprising a thick body 51 extending transversely across the stringer tape 50 and disposed around the lower end of the stringer tape 50. A pair of parallel projections 52,53 extends from the body 51 in a direction away from the stringer tape 50, and they are spaced transversely from each other across a wale-free region 54 in the stringer tape 50. The slide fastener 48 is attached to a knit fabric 58 by chains of thread loops 55, the lowermost one of which extends around the thick body 51 and is located between the projections 52,53 against displacement off the body 51. The reinforcement body 51 has a pair of protuberances 56,57 projecting in a direction perpendicular to the stringer tape 50 and positioned substantially in alignment with the projections 52,53, respectively, in the longitudinal direction of the stringer tape 50.

Figure 7:
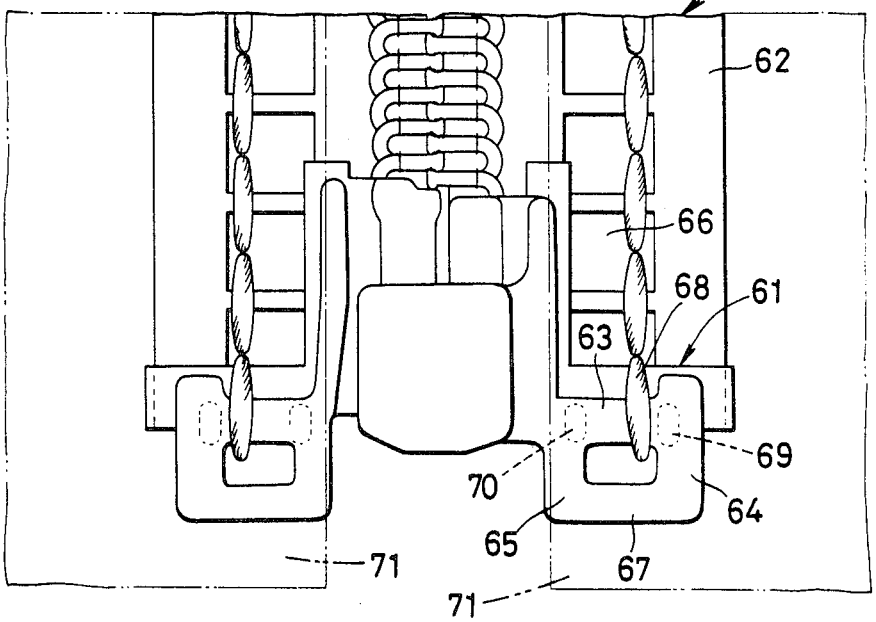

In a modified separable slide fastener 60 illustrated in FIG. 7, a reinforcement member 61 on a lower end of each stringer tape 62 comprises a thick transverse body 63 disposed around the lower end of the stringer tape 62 and having a pair of parallel spaced projections 64,65 extending away from the stringer tape 62 and disposed one on each side of a wale-free region 66 in the stringer tape 62. The projections 64,65 are interconnected by a connector 67 extending therebetween and spaced from the reinforcement body 63. When the separable slide fastener 60 is attached to a knit fabric 71 by thread loops 68, the lowermost one of the thread loops 68 extends around the body 3 and is located between the projections 64,65. Thus, the projections 64,65 prevent the lowermost loop 68 from being displaced off the reinforcement body 63. The connector 67 serves to stabilize the lower end of the slide fastener 60 when the latter is mounted on the knit fabric 71. The reinforcement body 63 also has a pair of protuberances 69,70 which serves to prevent the lowermost thread loop 68 from being displaced and becoming worn.

Figure 8:
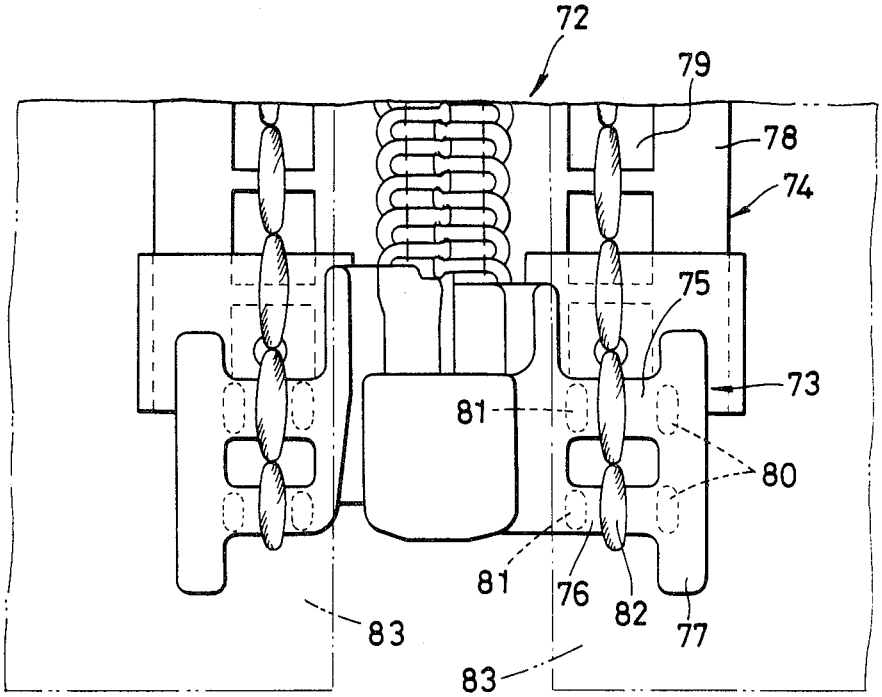

Another modified separable slide fastener 72 shown in FIG. 8 comprises a reinforcement member 73 mounted on each stringer tape 74 and including a pair of parallel spaced thick bodies 75,76, the body 75 being disposed around a lower end of the stringer tape 74 and the body 76 being spaced from the stringer tape 74. A projection 77 extends from the reinforcement body 76 in a direction away from the stringer tape 74 substantially in alignment with a web 78 of the tape 74 located outwardly of a wale-free region 79 in the tape 74. Each of the reinforcement bodies 75,76 has a pair of spaced protuberances 80,81 projecting perpendicularly to the stringer tape 74. When the separable slide fastener 72 is attached to a knit fabric 83 by chains of thread loops 82, the projection 77 and the protuberances 80,81 on the body 76 serve to prevent the lowermost thread loop from becoming disposed off the body 76 under forces applied via the knit fabric 83 laterally to the slide fastener 72. With the arrangement shown in FIG. 8, the reinforcement member 73 serves to stabilize the lower end of the slide fastener 72 on the knit fabric 83 and also to allow thread loops to be fastened around the reinforcement bodies 75,76 for dependable prevention of displacement of such thread loops.

Figure 9:
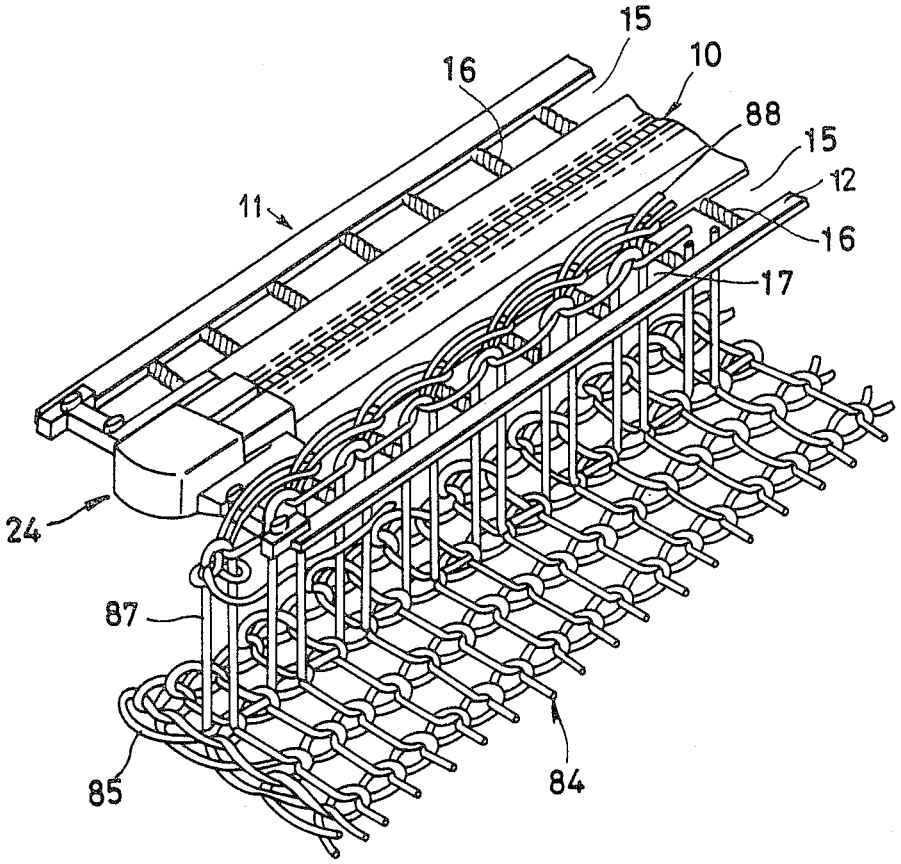
FIG. 9 is an enlarged fragmentary perspective view of the separable slide fastener of FIG. 2 as attached to a knit fabric on a linking machine.

FIG. 9 is illustrative of a manner in which the separable slide fastener 10 shown in FIG. 2 is knit into a knit fabric 84 such as of a cardigan sweater along an edge 85 thereof. The stringer tape 11,12 (shown inverted) is fastened to the knit fabric 84 by a first row of loops 87 extending walewise through the knit fabric 84 and the row of openings 17 in the wale-free region 15 in the stringer tape 12. A linking thread 88 in the form of a row of loops or chain stitches is interlooped with the first row of loops 87 projecting through the openings 17 to connect the stringer tape 12 and the knit fabric 84 together. Such linking operation can be carried out by an ordinary knitting machine or a linking machine or looper (not shown).

Although various minor modifications may be suggested by those versed in the art, it should be understood that we wish to embody within the scope of the patent warranted hereon, all such embodiments are reasonably and properly come within the scope of our contribution to the art.

We claim as our invention:

1. A separable slide fastener comprising:

(a) a pair of warp-knit stringer tapes each including a pair of first and second webs with a wale-free region extending longitudinally therebetween, and a connector thread interconnecting said first and second webs transversely across said wale-free region defining permanent apertures at longitudinal intervals, said connecting thread having a plurality of transverse portions extending across said wale-free region between said first and second webs, said stringer tapes being juxtaposed with said second webs disposed adjacent to each other, said wale-free region being receptive of a chain of thread loops for connecting said stringer tape to a fabric;

(b) a pair of rows of coupling elements each mounted on said second web of one of said stringer tapes remotely from said wale-free region;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a pin mounted on the other stringer tape at one end thereof, and insertable into said box; and (e) a reinforcement member mounted on each of said stringer tapes at said one end thereof and connected to said separable bottom end stop and extending between said first and second webs across said wale-free region, said reinforcement member including means adjacent to said wale-free region for extending through and thus anchoring an end of the chain of thread loops on said reinforcement member against displacement thereoff.

2. A separable slide fastener according to claim 1, said reinforcement member including a molded body disposed around said one end of the stringer tape and extending transversely of said stringer tape, said anchoring means comprising a projection extending from said body substantially in alignment with said first web and projecting away from said stringer tape.

3. A separable slide fastener according to claim 2, said anchoring means including a pair of molded protuberances disposed on said body one on each side of said wale-free region and projecting in a direction perpendicular to the plane of said stringer tape.

4. A separable slide fastener according to claim 2 said anchoring means including a second molded projection extending from said body parallel to said first-mentioned projection and spaced transversely from the latter, said second projection extending away from said stringer tape.

5. A separable slide fastener according to claim 4, said anchoring means including a molded connector extending between said projections and spaced from said body and said stringer tape.

6. A separable slide fastener according to claim 1, said reinforcement member including a pair of first and second molded bodies extending transversely of said stringer tape in parallel spaced relation to each other, said first body being disposed around said one end of the stringer tape, said second body being spaced from said one end of the stringer tape, and said anchoring means comprising a projection extending from said second body substantially in alignment with said first web and projecting away from said stringer tape.

7. A separable slide fastener according to claim 6, said anchoring means including a pair of protuberances disposed on each of said bodies one on each side of said wale-free region and projecting in a direction perpendicular to the plane of said stringer tape.

* * * * *